United States Patent [19]

Gewiss

[11] 4,012,932

[45] Mar. 22, 1977

[54] MACHINE FOR MANUFACTURING HERRINGBONE-PLEATED STRUCTURES

[75] Inventor: Lucien Victor Gewiss, Vernon, France

[73] Assignee: Marc Wood S.A., Paris, France

[22] Filed: June 5, 1975

[21] Appl. No.: 584,125

[30] Foreign Application Priority Data

June 6, 1974 France ..... 74.19523

[52] U.S. Cl. ..... 72/187; 72/190; 93/1 H; 264/287

[51] Int. Cl.[2] ..... B21D 5/16

[58] Field of Search ..... 72/177, 187, 190; 156/462, 474; 264/286, 287; 93/1 H, 84 R; 425/336

[56] References Cited

UNITED STATES PATENTS

| | | | |
|---|---|---|---|
| 2,163,063 | 6/1939 | Romanoff | 72/196 |
| 2,826,239 | 3/1958 | Villoresi | 264/287 |
| 2,901,951 | 9/1959 | Hochfeld | 264/287 |
| 3,809,199 | 5/1974 | Bessiere | 93/84 |

*Primary Examiner*—Lowell A. Larson
*Attorney, Agent, or Firm*—Lane, Aitken, Dunner & Ziems

[57] ABSTRACT

A machine for manufacturing herringbone-pleated structures of a type particularly suitable for use in cylindrical or flat filter elements. The machine includes consecutive feeding forming and bunching components by which a continuous band of flat sheet material, which may be pre-pleated longitudinally, is fed between a pair of endless forming assemblies which cooperate to form continuously a roughed-out shape of the final herringbone-pleated structure and which also advance to a bunching means positioned downstream from the forming assemblies. The bunching means operates to tighten up the folds of the roughed-out shape both longitudinally and transversely to provide the final structure.

17 Claims, 18 Drawing Figures

MACHINE FOR MANUFACTURING HERRINGBONE-PLEATED STRUCTURES

BACKGROUND OF THE INVENTION

The present invention concerns a machine for producing herringbone-pleated structures from sheet material in which alternating transverse folds made along parallel ridge lines are connected together by alternating longitudinal folds. Such structures are particularly useful in the manufacture of filter elements.

Pleated structures of this type can be made to achieve a great variety of forms and can, for example, comprise broken or undulated ridge lines which are in principle, identical and equidistant. Each of these breaks or undulations is connected to that of the preceding ridge and the following ridge by a small longitudinal fold, or a small undulation in the case of undulated ridges. It will be noted that all of these small folds, or small undulations, are alternately concave and convex and reverse themselves as they pass from one ridge to the next.

The machines used in the past for the production of such structures have never given complete satisfaction, either because they are very complicated and hence very costly, or else because their efficiency has been low and resulting in high production costs.

SUMMARY OF THE PRESENT INVENTION

In accordance with the present invention, the disadvantages of prior machines are overcome by a machine for making structures of the above-mentioned type in which sheet material stock is continuously fed to the machine and through forming assemblies of a shape corresponding at least in part to a rough outline of the structure to be realized, the forming assemblies being driven in continuous motion in order to positively drive the roughed-out shape thus formed during movement thereof in a downstream direction to a means for transversely and longitudinally tightening up the folds of the roughed-out shape to form the final herringbone-pleated structure. The machine is constituted by basic moving parts having a circular or orbital motion to minimize inertia problems, and thus makes possible the attainment of production rates which substantially lower the manufacturing costs of the structures obtained.

In one particular embodiment of the invention, the forming assemblies each include rows of parallel blades suitably sloped with respect to each other and designed to mark or impress alternately in the sheet material stock the alternating longitudinal folds, while at the same time initiate the transverse folds of the structure, the rows of blades being carried by endless chains driven in continuous orbital motion. The provision of special blades for marking or impressing the transverse folds is not necessary since these folds are automatically created by the action of the blades designed for making the longitudinal folds due to the malleability of the sheet material.

In a variation of the invention, designed more particularly for manufacturing structures in short production runs, each of the forming assemblies is established by a relieved surface in polypropylene, for example, mounted on a flexible endless belt driven in continuous motion. The relieved surface is of such configuration to directly complement the roughed-out shape of the structure to be formed. Thus it is possible to achieve numerous types of herringbone structures, including structures having parallel but not equidistant ridge lines, provided of course, that the structure reproduces itself identically over a length corresponding to that of the carrier belt or a submultiple of this length.

Preferably, the machine according to the invention includes in addition to the forming assemblies, two parallel channeled cylinders or rollers, rotatable in opposite directions and at the same speed, for folding the sheet of material along transversely alternating longitudinal folds upstream from the forming assemblies. Such folds correspond to the longitudinal folds of the pleated structure to be formed and facilitate the forming of the roughed-out shape by the forming assemblies.

The means for longitudinally tightening up or bunching the folds of the roughed-out shape includes two endless belts located on opposite sides of the sheet of material and driven in opposite directions at a linear speed less than that of the forming assemblies. In addition, the endless belts are mounted on a frame capable of oscillating about a fixed horizontal axis located toward the downstream end of the frame, by the actuation of a rod driven by an eccentric. The transverse ridges of the roughed-out shape thus bear alternately on each of the two endless belts and the oscillating motion of the latter causes the corresponding folds to close. These folds are then tightened up automatically by virtue of the braking effect exerted on the shape by the endless belts. The folds of the roughed-out shape are transversely bunched or tightened up by means including two stacks of lateral laminations, inclined symmetrically in such a manner as to form a converging passage and arranged on either side of the sheet of material between the two endless belts. At least certain ones of these laminations are actuated in a sinusoidal motion by means of eccentrics in order to exert a progressive lateral compression on the structure while at the same time contributing toward its advance.

Preferably, the feed mechanism comprises at least one roll on which is wound the sheet material stock, this roll being slideably mounted between vertical guides in such a manner that its lower periphery rests directly on the periphery of the upper channeled cylinder or roller. This arrangement assures that the unrolling of the sheet of material will be perfectly uniform.

In an alternative embodiment of the invention designed for the production of structures with asymmetrical folds, the feed mechanism comprises two rolls of sheet material mounted to be vertically movable and which bear respectively on the two channeled cylinders under the action of a balancing system connecting the shafts of these two rolls. Also, means are provided for passing through the machine an intermediate band which is interposed between the sheets of material coming from the two feed rolls. The intermediate band can be an endless belt, for example, which has been pre-pleated longitudinally. It can also be established simply by an additional sheet of material fed from a third feed roll located upstream from the first two. This additional sheet of material plays the role of the aforementioned endless belt but is discharged out of the machine herringbone-pleated and is therefore usable, as is. However, it is to be noted that the pleated structure thus obtained does not constitute either a true herringbone-pleated structure nor an asymmetrical structure since it is established by rounded folds of equal radii on both sides.

BRIEF DESCRIPTION OF THE DRAWINGS

Several embodiments for executing the invention are hereinafter described, as examples, by reference to the annexed drawings in which.

DETAILED DESCRIPTION OF THE PREFERRED EMBODIMENTS

Figure 1:
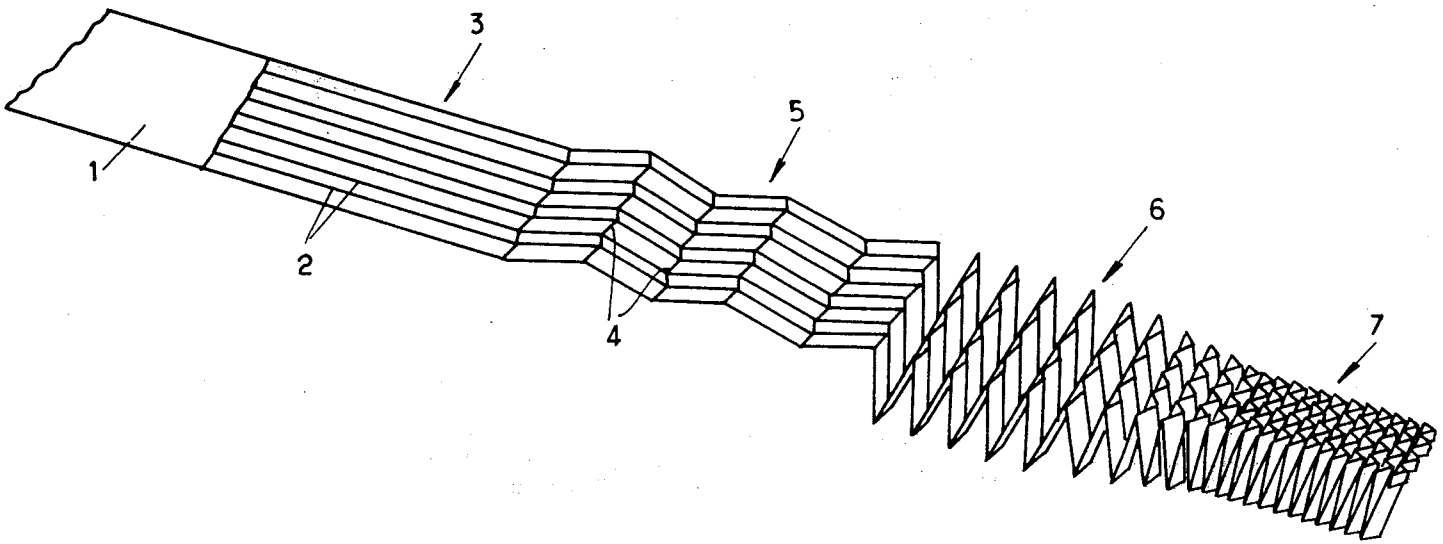
FIG. 1 is a perspective view showing various stages of forming the herringbone-pleated structure from a flat sheet of material.

In FIG. 1 of the drawings, the sheet of malleable material from which the desired herringbone-pleated structure is formed is depicted in the course of its progression through the various operations performed by a machine according to the invention which will be described hereinafter. The initially flat sheet, designated by the reference numeral 1, is first folded along longitudinal folds lines 2 which alternate transversely to provide an area or portion 3 of small longitudinal folds corresponding to longitudinal folds of the structure to be formed. The longitudinally folded sheet 3 is then folded transversely along parallel zig-zag ridge lines 4 to provide a roughed-out shape 5 corresponding in general outline to the final structure to be formed. It will be noted that this folding has the effect of reversing every other one of the longitudinal folds 2 of the pleated part 3. The folds of the roughed-out shape 5 thus formed are then tightened up longitudinally, as represented at 6, and finally transversely in order to form the final herringbone-pleated structure 7. It should be noted that when the material of the sheet 1 so lends itself, it is possible to avoid the stage of pre-forming the longitudinal folds represented at 3. In such case, the sheet 1 passes directly from the flat shape to the shape of the roughly-outlined structure represented at 5.

Figure 2:
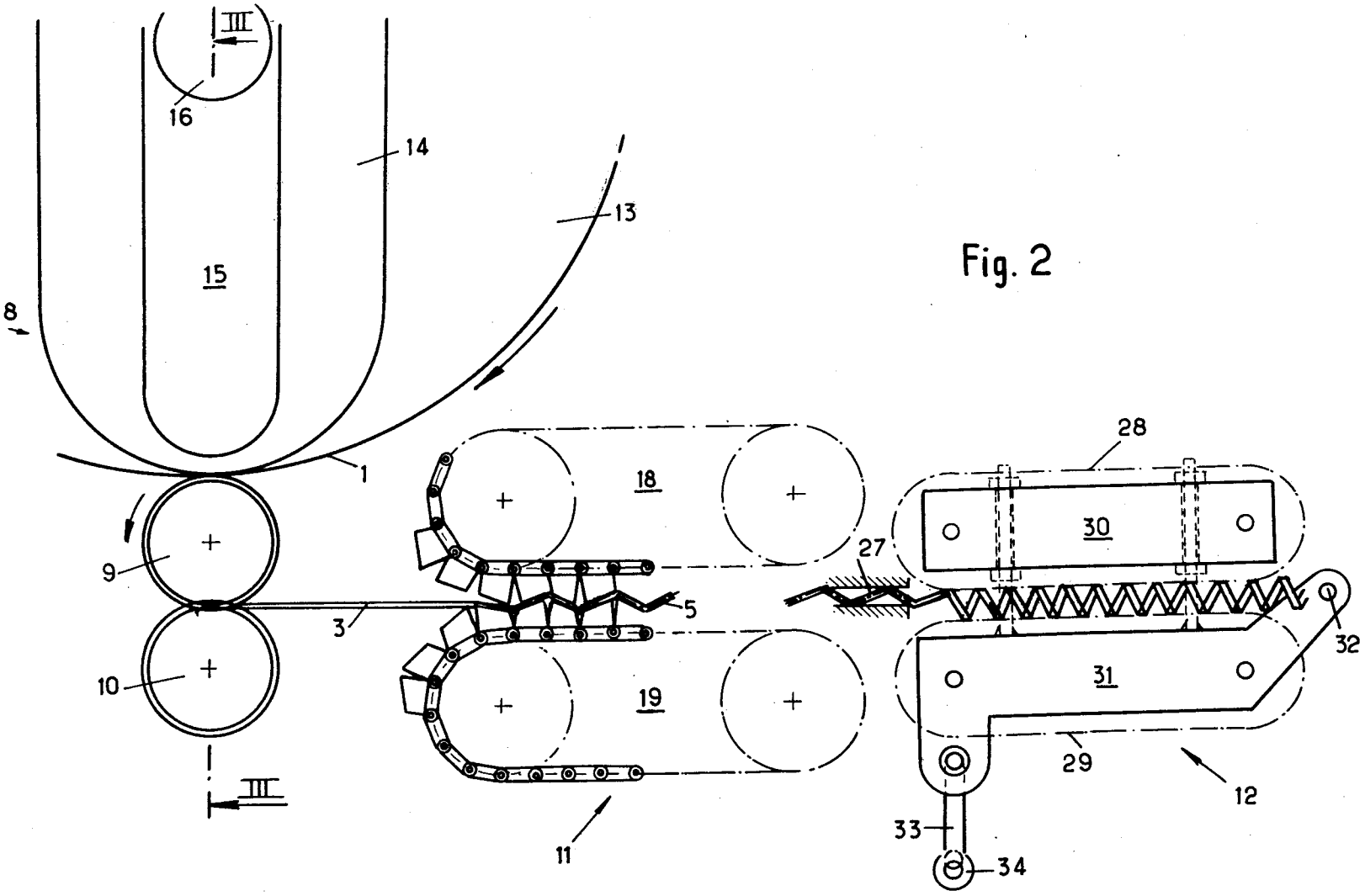
FIG. 2 is a simplified general view in elevation of a machine according to the invention for producing the structure represented in FIG. 1.

Referring now to FIG. 2, it can be seen that the machine according to the invention generally includes in an order proceding from left to right in FIG. 2 or from upstream to downstream in terms of material movement, a continuous feed mechanism 8, two channeled cylindrical rollers 9 and 10, a forming unit 11 and means 12 for tightening longitudinally the transverse folds of the structure.

The feed mechanism 8 includes a roll 13 of the band of sheet material to be herringbone-pleated. According to the invention, this roll is mounted for movement vertically between two fixed side plates 14 by virtue of vertical slots 15 provided in the plates and which receive the shaft 16 of the roll. Thus the roll rests directly on the periphery of upper channeled cylinder 9 under the effect of its own weight.

Figure 3:
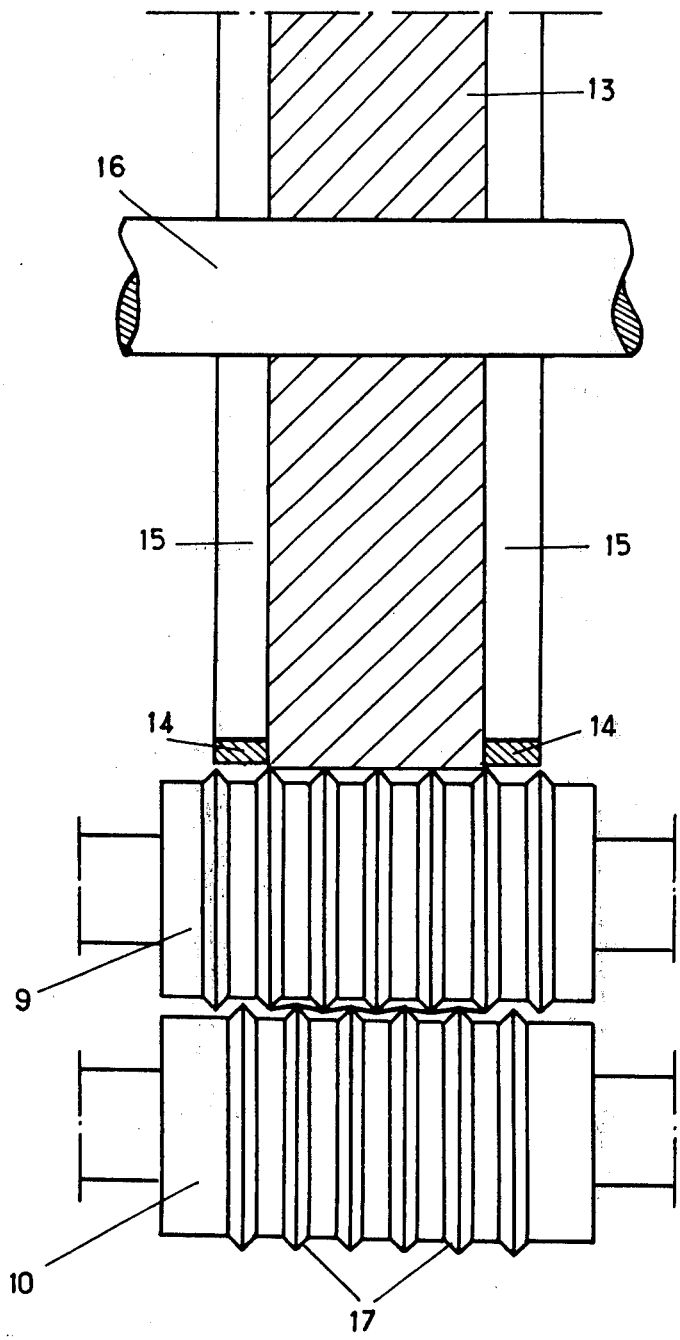
FIG. 3 is a simplified view in cross-section along line III—III of FIG. 2.

The sheet of material unwinds from roll 13 in the direction indicated by the arrows and passes over the upstream half of upper channeled roller or cylinder 9, then passes between the two rollers 9 and 10. As can be seen more clearly in FIG. 3, each of the rollers 9 and 10 is provided with ribs 17 whose V-shaped cross-section is adapted to the form of pleating desired. As shown, ribs 17 of roller 9 are offset axially by half a pitch with respect to those of the roller 10. The sheet which passes from the rollers 9 and 10 is thus longitudinally pleated by transverse stretching of its material and at that point appears in the form shown at 3 in FIG. 1.

As mentioned above, the pre-pleating by transverse stretching of the material can be omitted when the characteristics of the material permit. The channeled rollers 9 and 10 are then simply replaced by smooth cylinders so that the sheet remains flat and passes in that state to the forming unit 11 which follows.

The forming unit 11 is shown in FIG. 2 to include essentially two endless forming assemblies 18 and 19 between which the sheet of pre-pleated (or in some cases flat) material 3 passes and which are designed in the form of endless chains driven continuously in the downstream direction by motive means which are not shown. These two forming assemblies are arranged face to face and provide between them a space corresponding to the roughed-out shape 5 to be formed.

Figure 4:
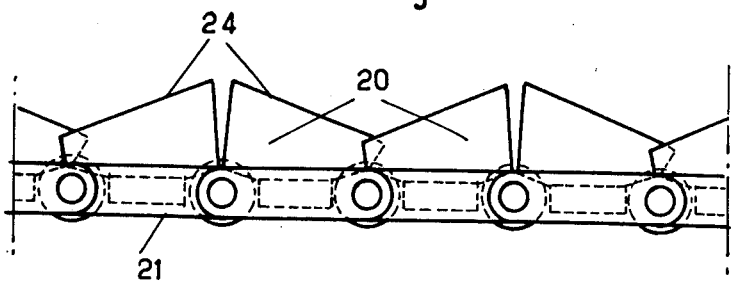
FIGS. 4 and 5 are detailed elevation and plan views of the forming assemblies used in the machine according to the invention.
Figure 5:
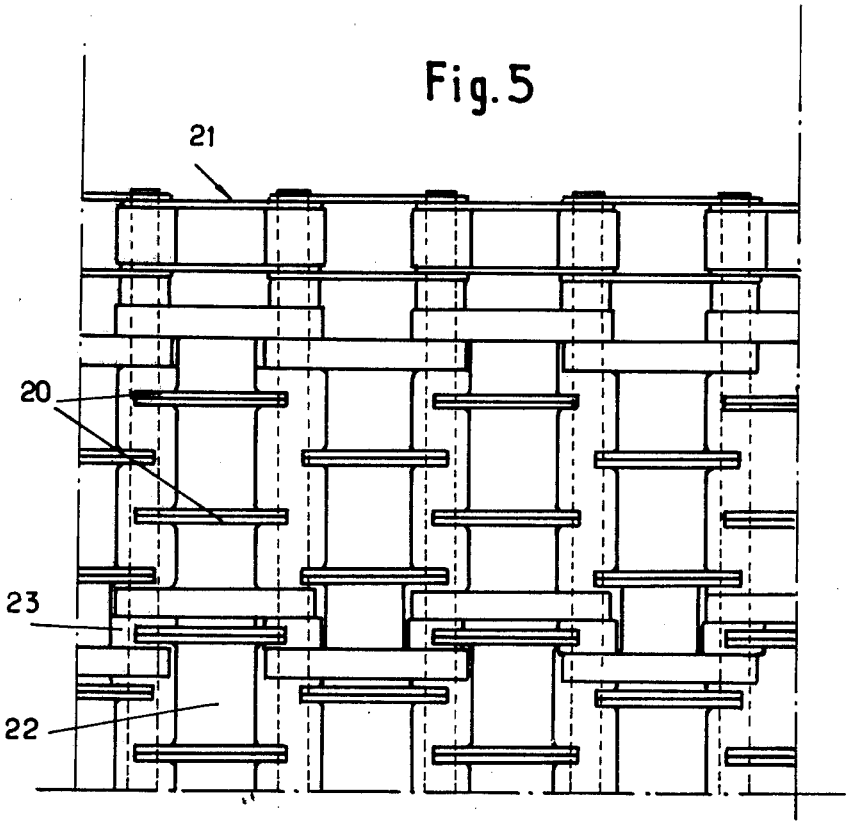

As can be seen more clearly in FIGS. 4 and 5, each of the forming assemblies 18 and 19 include in this embodiment, transverse rows of parallel blades 20 supported in staggered formation by two lateral endless chains 21. Each row of blades 20 is carried by a long link such as 22 which is threaded on opposite ends into the pivot pins of chain 21. Support rollers 23, similar to those of the chains 21, are moreover provided between adjacent links 22 in order to give the assembly a certain rigidity, particularly where structures of great width are produced.

The blades 20 are of a trapezoidal shape and provided with active or working ridges 24 sloped in opposite directions with respect to each other so as to correspond to or develop the relatively obtuse angles of the folds in the roughed-out shape 5 to be formed. Also the blades 20 of the assembly 18 are offset or staggered with respect to the blades of the assembly 19. Thus these blades are designed to mark or impress in relief on the sheet of material, the longitudinal creases of the alternating folds with possible stretching of the material transversely. When the sheet of material is pre-pleated, as represented at 3, this longitudinal impressing results alternately in a confirmation of the longitudinal fold 2 already formed and in a reversal of the said fold.

In contrast, when the sheet of material is not pre-pleated, the alternately concave and convex longitudinal folds are formed directly by blades 20 by passage of the flat sheet between the two forming assemblies 18 and 19. It is to be noted that there does not exist on the forming assemblies 18 and 19 any blade corresponding to the folds of the transverse zig-zag ridges 4. These folds are automatically formed at the time of the longitudinal marking as a result of the malleability of the material of the sheet 1.

Thus there is obtained at the output of the forming unit 11, a rough outline of the structure to be formed similar to that shown at 5 in FIG. 1. Moreover, the forming unit positively and firmly drives the roughed-out shape 5 in the downstream direction so that it can also be used for drawing the sheet 1 from roll 13 through channeled rollers 9 and 10.

Figure 6:
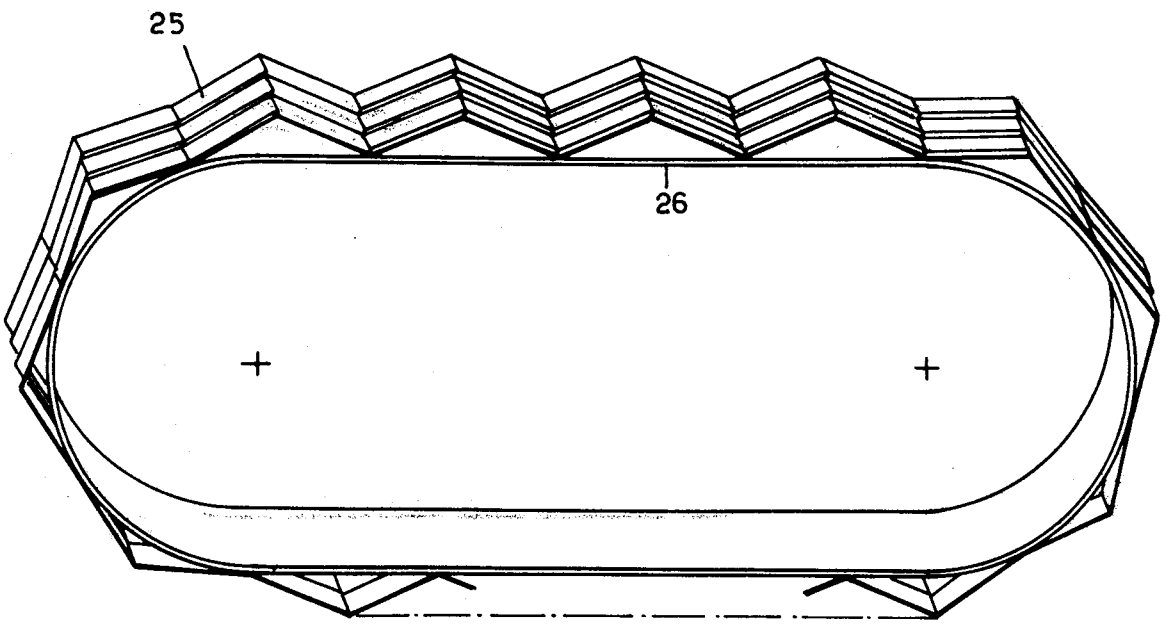
FIG. 6 is a simplified view in perspective illustrating a variation in the design of the forming assemblies.
Figure 7A:
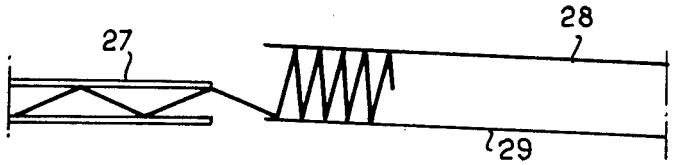
FIGS. 7*a* to 7*i* are schematic views illustrating the various stages of closing the transverse folds of the structure between the two corresponding endless belts.
Figure 7B:
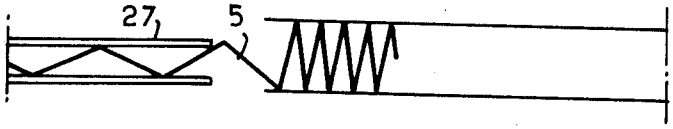
Figure 7C:
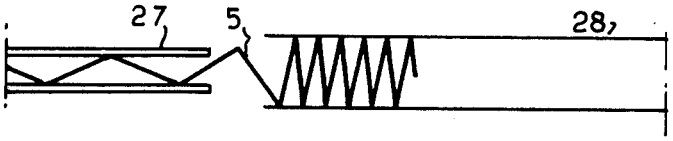
Figure 7D:
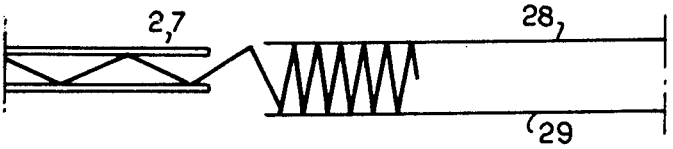
Figure 7E:
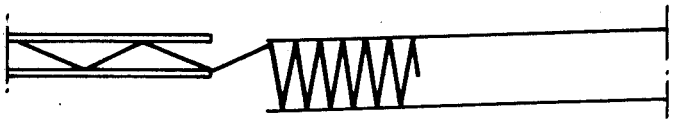
Figure 7F:
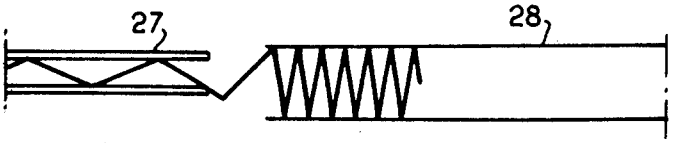
Figure 7G:
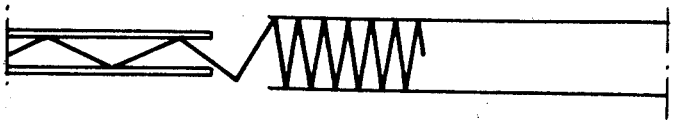
Figure 7H:
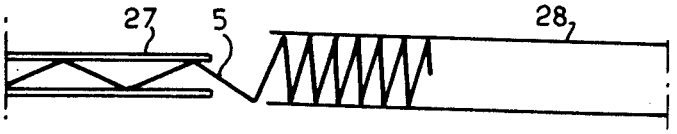
Figure 7I:
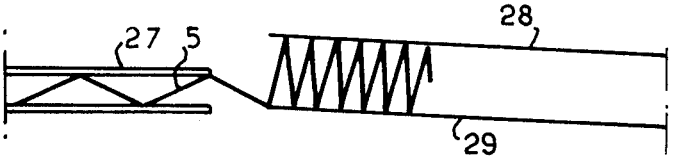

In an alternative embodiment illustrated in FIG. 6, which is more specially designed for manufacturing herringbone-pleated structures in short production runs, each of the forming assemblies of forming unit 11 includes a forming structure 25 which complements in relief the roughed-out shape to be formed. This structure is preferably formed of a practically indestructible material such as polypropylene and it is fixed by cementing or stapling, for example, onto a flexible endless belt 26 driven continuously as the chains 21 of the preceding embodiment. The use of such a polypropylene structure as a forming assembly makes it possible to realize very easily and cheaply numerous types or shapes of herringbone-pleated structures, even in short production runs.

The roughed-out structure 5 passing out of the forming unit 11 is pushed by the latter in the downstream direction through a creasing duct 27 and then to bunching means 12 for longitudinally tightening up the transverse folds of the roughed-out shape 5. The bunching means includes essentially two endless belts 28 and 29 located on opposite sides of the sheet material and spaced so that the distance between mutually facing runs corresponds substantially to the desired pleat height. The mutually facing inside runs of the two belts 28 and 29 are driven in the downstream direction at the same linear speed by motive means (not shown). The linear speed of such runs, however, is selected to be substantially less than that of the forming assemblies 18 and 19. For example, the speed of the belts 28 and 29 is preferably selected to be one-fifth the speed of the chains 21 in order to provide the desired braking effect on the structure to assure a tightening up of the transverse folds.

Each of belts 28 and 29 is moreover mounted on a frame 30 and 31, respectively. Frame 30 is attached to frame 31 by means of threaded rods and nuts which makes it possible to vary at will the spacing of the two belts as a function of the structure to be produced. The frame 31 is mounted so as to pivot about horizontal axis 32, located toward the downstream end of the frame 31. Thus, the frame can be caused to oscillate about this axis under the action of a connecting rod 33 driven by an eccentric 34.

The amplitude of the oscillation of the two belts 28 and 29 is at most equal to a fraction of the pleat height, and its frequency is the same as that at which the pleats are formed. Thus, when the mechanism is suitably adjusted, the pleats of the roughed-out shape 5 emerge completely from duct 27 at the same moment when the downstream ridge contacts the corresponding belt 28 or 29. The transverse ridges 4 of the roughed-out structure, therefore, bear alternately on each of the two belts 28 and 29 and the synchronized oscillating motion of these belts then automatically causes the transverse folds to close. The schematic illustration of FIG. 7 moreover shows very clearly the consecutive steps of the operation for closing these pleats. The pleats may be further tightened up by reason of the braking effect exerted by the two belts.

Figure 8:
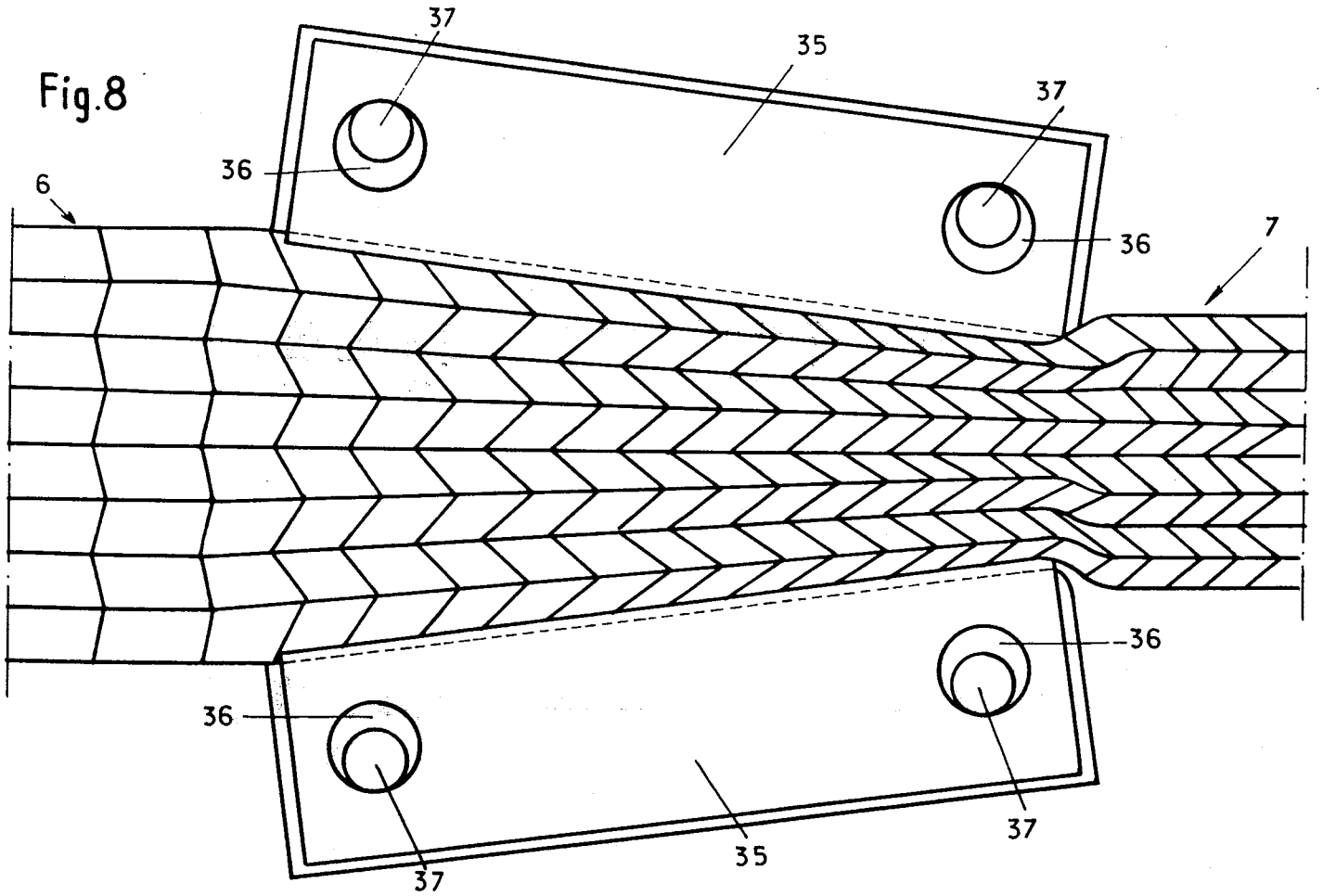
FIG. 8 is a simplified plan view of the means used for tightening up the folds of the structure transversely.

Between the two endless belts 28 and 29 are provided further means for transversely tightening up or bunching the folds of the structure and thus forming the final herringbone structure with gathered-in pleats as shown at 7 in FIG. 1. Such means are shown in FIG. 8 and are essentially formed by two stacks of lateral laminations 35 symmetrically inclined in such a manner as to form a converging passage. They are, of course, located on opposite edges of the structure between the two endless belts 28 and 29 and extend over approximately the downstream half of the latter.

In the two stacks of laminations 35, every other lamination is fixed whereas the others are designed to move under the action of the eccentrics 36 having shafts 37 passing through apertures in the fixed laminations. All these eccentrics are driven together at the same speed and thus drive the movable laminations with a sinusoidal motion which enables them to protrude with respect to the fixed laminations and remain parallel to them. As a result of this organization, the moving laminations tend to cause the structure to progress in the downstream direction while exerting on it a lateral pressure which causes its longitudinal pleats to tighten up. When it emerges from compression between laminations 35, the structure naturally expands in part and then constitutes a completely finished herringbone structure such as the one shown at 7 in FIG. 1.

It clearly appears from the foregoing that the machine according to the invention makes it possible to manufacture herringbone structures in continuous process at very high production rates and hence at low manufacturing costs. Indeed, all of its parts travel in a circular or orbital motion and consequently pose little or no problem of inertia.

Figure 9:
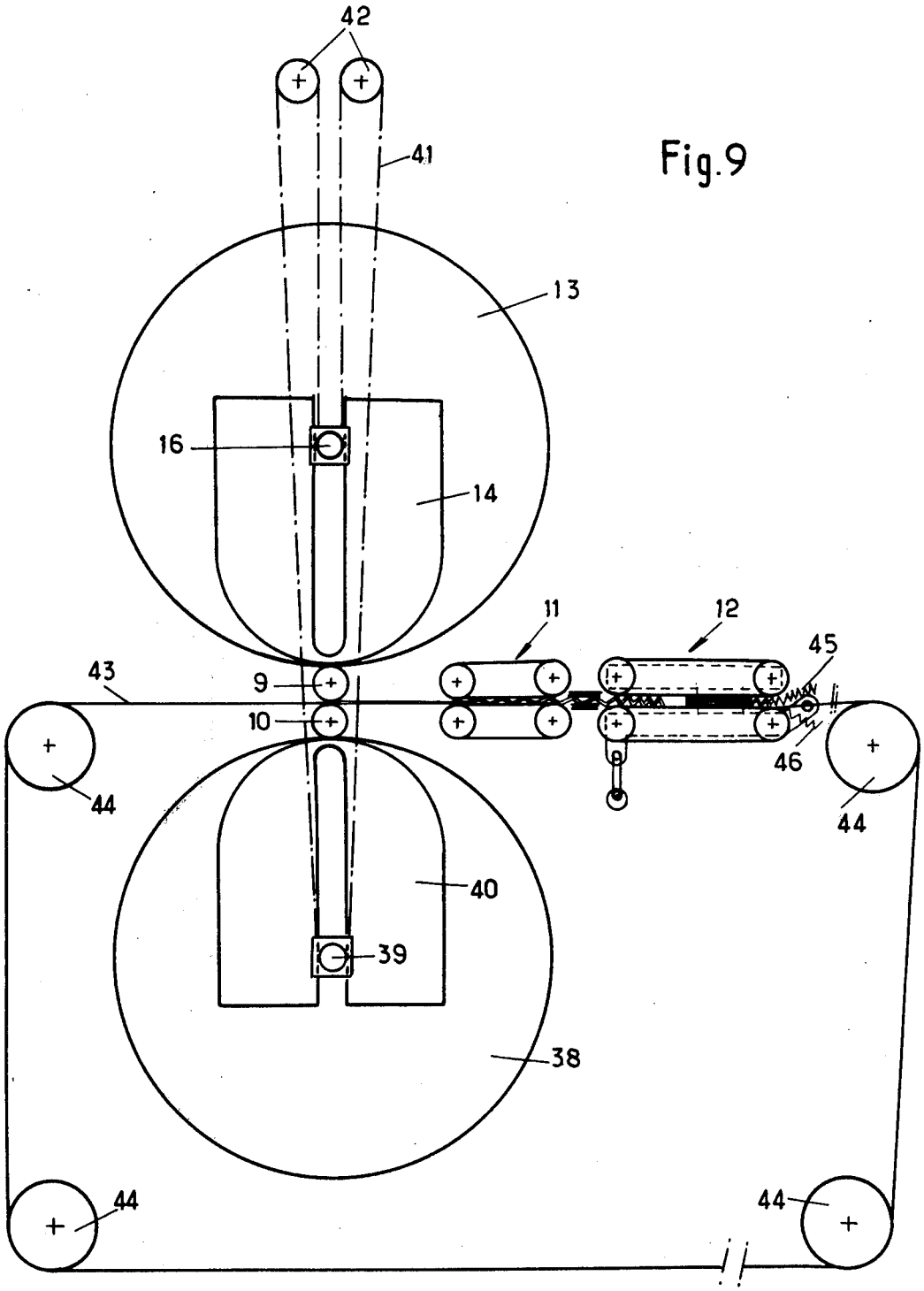
FIG. 9 is a schematic view illustrating a variation in the design of the machine according to the invention when it is applied to the particular case of producing structures with asymmetrical folds.

In addition to herringbone pleated structures with symmetrical folds, such as that illustrated at 7 in FIG. 1, the machine of this invention may be adapted to form asymmetrical folds in such a structure as disclosed in French Pat. No. 1,440,725, filed Apr. 13, 1965, U.S. Pat. No. 3,550,423 issued Dec. 29, 1970 and U.S. Pat. No. 3,726,408 issued Apr. 10, 1973 all to the present applicant, such disclosures being incorporated herein by reference. FIG. 9 illustrates schematically a machine adapted to the manufacture of such structures with asymmetrical folds.

In FIG. 9 it will be noted at the outset that aside from forming unit 11 and means 12 for tightening up the pleats, the roll 13 is again mounted to be vertically movable between its side plates 14 in such a manner as to rest on upper channeled cylinder 9. Combined with the roll 13 is a second roll 38 having a shaft 39 also mounted for vertical movement between plates 40. In order that the roll 38 will normally bear on the periphery of lower channeled cylinder or roller 10, there is provided an automatic balancing system for the two rolls. The balancing system is formed by one or more belts 41 which connect shafts 16 and 39 of the rolls by passing over one or more return pulleys 42. Thus the two rolls remain constantly in contact with the peripheries of the two rollers 9 and 10 even though they diminish in diameter as they unwind so that the two sheets remain perfectly aligned and coincident without deviation.

In a known manner, an endless belt 43, preferably pre-pleated with small longitudinal folds, is interposed between the two sheets of material coming from rolls 13 and 38 and passes through the entire machine while being supported by four return pulleys 44. Downstream from means 13, two structures with asymmetrical folds, 45 and 46 respectively are discharged and automatically separate from each other under the tension exerted on endless belt 43 by the rollers 9 and 10 located at the head of the machine. Also it is possible to produce simultaneously and in the same manner more than two structures with asymmetrical folds, for example four or six, using simply rolls 13 and 38, each carrying convolutions of two or three thicknesses of superimposed sheets of stock material.

Figure 10:
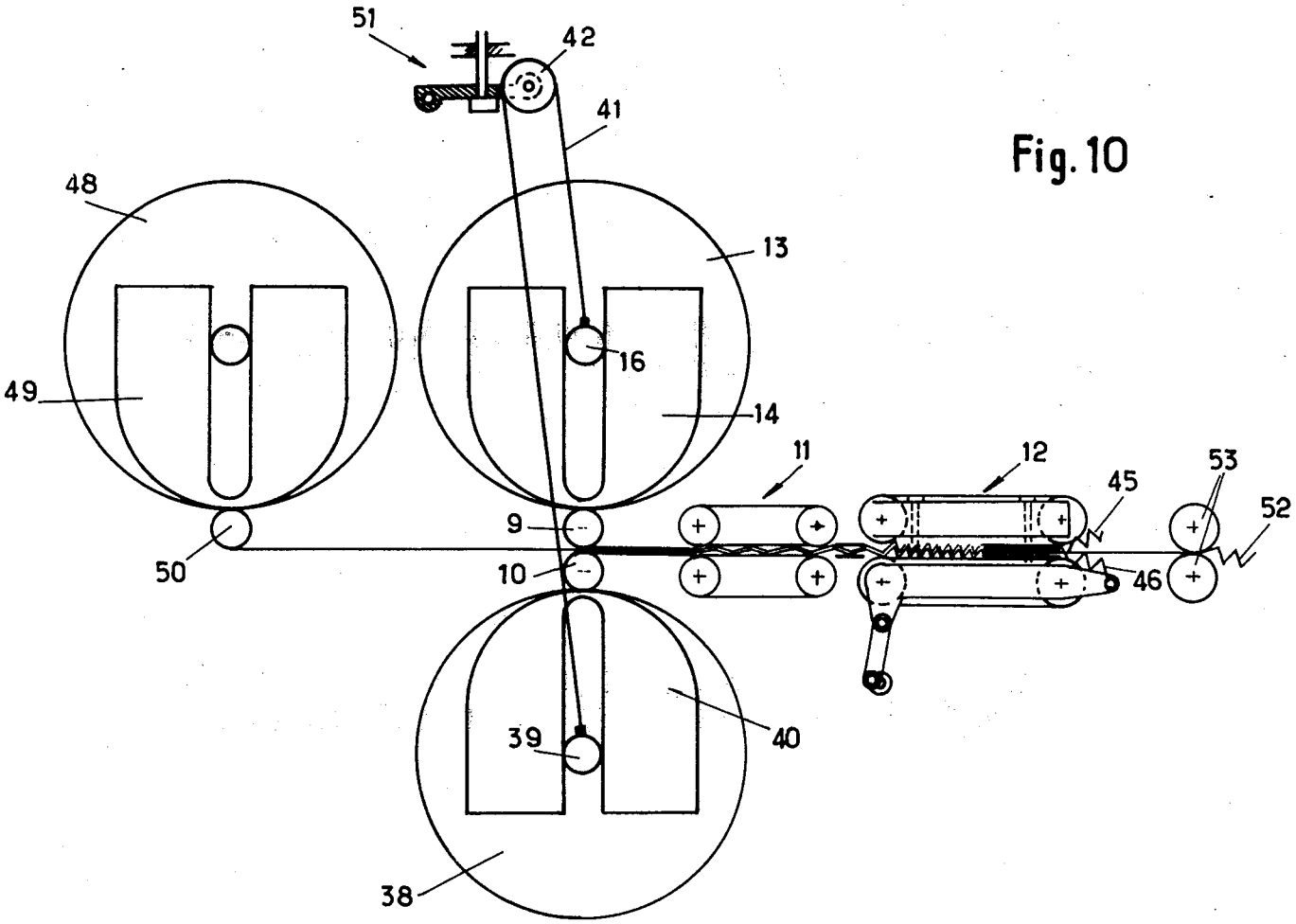
FIG. 10 is a schematic view of another variation in the design of the machine according to the invention and in which the intermediate endless belt is replaced with another sheet of material to be herringbone-pleated.

In the embodiment illustrated in FIG. 10, the aforementioned intermediate endless belt is replaced by a sheet of additional material 47 payed from a third feed roll 48. This roll is also mounted to be vertically movable between plates 49 and has its lower part resting on the periphery of a cylindrical roller 50 which is not channeled as rollers or cylinders 9 and 10. It is noted, incidentally, that the return pulley 42 of the balancing system for the two rolls 13 and 38 is designed to be adjustable in height by means of control device 51 in order to permit adjustment at the outset of the position of these rolls with respect to cylinders 9 and 10 with which they must be in contact.

In the operation of the embodiment of FIG. 10, at least two structures with asymmetrical folds 45 and 46 are discharged from the bunching means 12, possibly four or six in the case where several superimposed sheets are used, and a special central structure 52 whose pleats are rounded and equal on both sides. This particular structure is extracted from the assembly by means of light tension exerted on it by two cylinders 53 turning at a speed greater than the speed at which the structure is advanced through the machine. The tension is sufficient to disengage properly from each of its faces the structures with asymmetrical folds 45 and 46, but does not damage the central structure itself which automatically reassumes its herringbone-pleated shape at the output of cylinders 53. Such an arrangement makes it possible to produce an additional structure at each operation.

I claim:

1. A machine for manufacturing herringbone-pleated structures from flat sheet material and comprising alternating transverse folds located along ridge lines which are parallel to each other and which are connected together by alternating longitudinal folds, said machine comprising:

a pair of endless forming assemblies each supporting folding elements engagable with opposite sides of at least one strip of sheet material, said folding elements being positioned and shaped to establish a roughed-out shape of the transversely and longitudinally folded structure to be formed and movable continuously to advance the roughed-out shape in a downstream direction;

means for continuously feeding at least one strip of sheet material to said forming assemblies, said feeding means being positioned upstream from said forming assemblies; and bunching means positioned downstream from said forming assemblies for transversely and longitudinally tightening up the folds of the roughed-out shape to form the final herringbone-pleated structure.

2. The apparatus recited in claim 1 wherein said folding elements comprise parallel blades staggered in transverse rows, each of said blades having working edges inclined oppositely in successive rows to establish alternating obtuse angles, the blades on one of said pair of endless forming assemblies being offset relative to the blades on the other of said pair of endless forming assemblies whereby said working edges impress the sheet of material to form the alternating longitudinal folds while at the same time initiating transverse folding of the structure.

3. The apparatus recited in claim comprising endless chains for supporting said blades, said chains adapted to be driven in continuous motion.

4. The apparatus recited in claim 1 wherein said forming elements are established by shaped embossments on flexible endless belts, said embossments having a configuration and being arranged to establish a forming configuration complementing the complete roughed-out shape of the structure to be formed.

5. The apparatus recited in claim 1 including a pair of parallel channeled rollers rotatable in opposite directions and at the same speed, said rollers being positioned upstream from said forming assemblies and cooperating to pleat the strip of sheet material along transversely alternating longitudinal folds corresponding to the longitudinal folds of the pleated structure to be formed.

6. The apparatus recited in claim 1 wherein said bunching means comprises two endless belts located on opposite sides of the sheet of material, said endless belts being driven in opposite directions at the same linear speed relative to each other but at a lower speed than the speed at which said forming assemblies are moved to continuously form and advance said roughed-out shape.

7. The apparatus recited in claim 6 including a frame for supporting said two endless belts, said frame being mounted for oscillatory motion about a horizontal axis located toward the downstream end of said frame.

8. The apparatus recited in claim 7 wherein said bunching means comprises two stacks of lateral laminations symmetrically inclined to establish a converging passage and located on opposite edges of the sheet material positioned between said endless belts, at least some of said laminations being driven to effect a sinusoidal motion to exert a progressive lateral compression on the structure while contributing toward its advance.

9. The apparatus recited in claim 1 wherein said feed means comprises a pair of vertically oriented parallel rollers between which the strip of sheet material is fed and means for supporting a supply roll of said sheet material on a vertically movable axis parallel to the axes of said rollers whereby the lower peripheral surface of said supply roll rests directly on the periphery of the uppermost of the roller pair irrespective of variations in the diameter of said supply roll.

10. The apparatus recited in claim 9 wherein said feed means comprises means supporting two supply rolls of said sheet material on such vertically movable axis, said supporting means including a balancing system for retaining the supply rolls peripherally against the upper and lower ones of said rollers.

11. The apparatus recited in claim 10 comprising means for passing an intermediate band between two sheets passing from said supply rolls and through said forming assemblies.

12. The apparatus recited in claim 11 wherein said intermediate band is established by a longitudinally pre-pleated endless belt.

13. The apparatus recited in claim 11 wherein said intermediate band is established by an additional sheet of material fed from a third feed roll positioned upstream from said first mentioned two supply rolls.

14. The apparatus recited in claim 1 wherein said alternating transverse folds are formed by folding elements each of which contains a longitudinally extending folding surface.

15. Bunching means for transversely and longitudinally tightening up the folds of a roughed-out shape corresponding in general outline to a herringbone-pleated structure having alternating transverse folds located along ridge lines which are parallel to each other and connected together by alternating longitudinal folds, said bunching means comprising:

means for advancing the roughed-out shape in a linear path at a preestablished linear speed;

means including a pair of endless belts having mutually facing runs spaced from each by a distance approximating the thickness of the final herringbone structure and movable continuously in said direction of feed but at a speed lower than said preestablished speed; and means supporting said endless belts for oscillating movement in synchronism with the longitudinal advance of alternating ridge lines in the roughed-out shape so that said mutually opposed runs alternately engage successive ridges in the roughed-out shape.

16. The method for manufacturing herringbone-pleated structures from flat malleable sheet material, the final herringbone-pleated structure having alternating transverse folds located along ridge lines which are parallel to each other and connected together by alternating longitudinal folds, said method comprising the steps of:

continuously feeding a band of flat sheet material longitudinally;

mechanically impressing alternating longitudinal folds in said sheet material during continuous longitudinal movement thereof, said impressing of longitudinal folds serving simultaneously to bend said sheet material transversely to initiate transverse folds along the parallel ridge lines, thereby to continuously form a roughed-out shape corresponding in outline to the final herringbone-pleated structure to be formed; and longitudinally and transversely tightening up said roughed-out shape to complete said herringbone-pleated structure during continuous movement of said roughed-out shape but at a linear speed slower than the speed at which said sheet material is fed during said longitudinal and transverse folding.

17. The method recited in claim 16 including the step of pre-pleating said band of sheet material along longitudinal folds lines.

* * * * *

UNITED STATES PATENT OFFICE

CERTIFICATE OF CORRECTION

Patent No. 4,012,932 Dated March 22, 1977

Inventor(s) Lucien Victor Gewiss

It is certified that error appears in the above-identified patent and that said Letters Patent are hereby corrected as shown below:

In the abstract, line 10, after "advance", insert --the roughed-out shape longitudinally from the feeding means--.

Column 8, line 12 (claim 2, line 1) after "claim", insert --2--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*